US007373241B2

(12) United States Patent
Bauerle et al.

(10) Patent No.: US 7,373,241 B2
(45) Date of Patent: May 13, 2008

(54) AIRFLOW CORRECTION LEARNING USING ELECTRONIC THROTTLE CONTROL

(75) Inventors: Paul A. Bauerle, Fenton, MI (US); David A. Stamm, Howell, MI (US)

(73) Assignee: GM Global Technology Operations, Inc., Detroit, MI (US)

( * ) Notice: Subject to any disclaimer, the term of this patent is extended or adjusted under 35 U.S.C. 154(b) by 81 days.

(21) Appl. No.: 11/516,013

(22) Filed: Sep. 5, 2006

(65) Prior Publication Data

US 2008/0053403 A1 Mar. 6, 2008

(51) Int. Cl.
*F02D 41/26* (2006.01)
*F02D 9/00* (2006.01)

(52) U.S. Cl. ..... 701/115; 123/399; 701/102

(58) Field of Classification Search ..... 123/361, 123/399; 701/102, 115
See application file for complete search history.

(56) References Cited

U.S. PATENT DOCUMENTS 6,698,398 B2 * 3/2004 Bauerle ..... 123/399
7,024,305 B2 * 4/2006 Stamm et al. ..... 701/102

* cited by examiner

*Primary Examiner*—T. M Argenbright

(57) ABSTRACT

A correction system and method for an electronic throttle control includes a generator module that generates a learned-correction value corresponding to a first air-learn index. The learned-correction value is used to compensate a throttle position. A correction module writes to a throttle position correction array with the learned-correction value when an air-learn value equals a predetermined stability threshold.

20 Claims, 5 Drawing Sheets

AIRFLOW CORRECTION LEARNING USING ELECTRONIC THROTTLE CONTROL

FIELD OF THE INVENTION

The present invention generally relates to vehicle electronic throttle control, and more particularly to throttle airflow correction in a vehicle.

BACKGROUND OF THE INVENTION

Vehicles driven by internal combustion engines generally employ intake system sensors including, but not limited to, a throttle position sensor (TPS), a mass airflow (MAF) sensor and a manifold absolute pressure (MAP) sensor. An engine control system implements an electronic throttle control (ETC) system that regulates engine torque output based on a throttle position signal, a MAF signal and a MAP signal. The engine control system can also regulate engine torque output using spark advance/retard, cam phasing and/or regulating fuel supply to the cylinders.

Throttle body deposits commonly occur in internal combustion engines during operation. Understanding and compensating for throttle body deposits is challenging. Statistical build variations in the ETC system components can alter the relationship between throttle position and airflow as well.

ETC systems can adapt to airflow variations resulting from throttle body deposits, throttle sensor variation, mass airflow meter variation, and manufacturing tolerances. ETC systems often slowly adapt or learn to compensate for airflow variations. The throttle position within a coked throttle body is adjusted to allow for an increase in airflow that compensates for less flow due to coking. The addition of greater airflow prevents drivability issues such as idle roll and stalls.

When a controller is reflashed or swapped, the learned values of airflow correction compensating for the coking are lost and drivability issues can result. The speed of learning compensating values can be an impediment to improving driving performance and stable idle speed. Balancing the speed of learning with accuracy of control can often be a difficult task.

SUMMARY OF THE INVENTION

A correction system and method for an electronic throttle control includes a generator module that generates a learned-correction value corresponding to a first air-learn index. The learned-correction value is used to compensate a throttle position. A correction module writes to a throttle position correction array with the learned-correction value when an air-learn value equals a predetermined stability threshold.

In other features, a throttle position sensor senses throttle position and an indexing module generates said first air-learn index based on the sensed throttle position.

In still other features, the air-learn value is set equal to zero and a second air-learn index is set equal to the first air-learn index when the stability conditions are not satisfied.

In still other features, the stability conditions include at least one of: the air-learn index does not exceed the air-learn threshold, the first air-learn index is equal to a second air-learn index, and the air-learn index is greater than zero.

In still other features, the correction module increments a volatile histogram at the first air-learn index when the learned-correction value is stored at said first air-learn index of said throttle position correction array. A shutdown module updates a non-volatile histogram indexed by air lean indexes based on the volatile histogram. The shutdown module updates said non-volatile histogram when at least one cell in said volatile histogram exceeds zero.

In still other features, an initialization module clears the air-learn value, sets a second air-learn index equal to zero, and determines the air-learn threshold when at least one of: power-up, running reset, and other reset has occurred. The initialization module sets the air-learn threshold equal to a cell of the non-volatile histogram. The cell contains a value that is greater than zero.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION OF THE PREFERRED EMBODIMENTS

Figure 1:
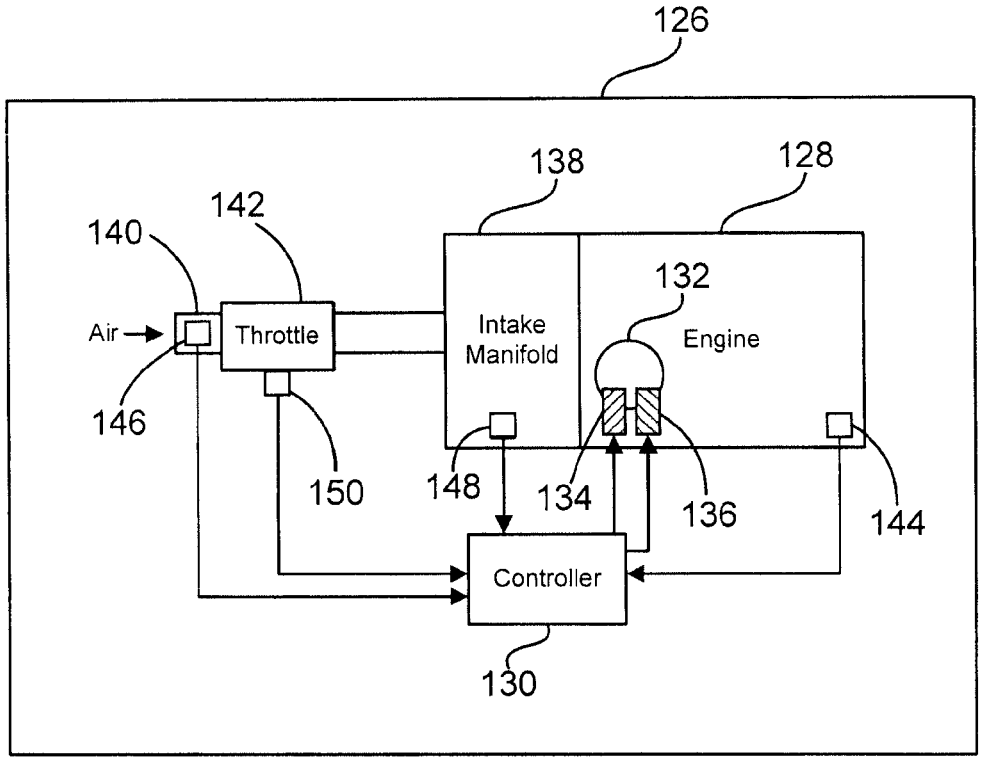
FIG. 1 is a block diagram of a vehicle in accordance with the present invention.

The following description of the preferred embodiment is merely exemplary in nature and is in no way intended to limit the invention, its application, or uses. For purposes of clarity, the same reference numbers will be used in the drawings to identify similar elements. As used herein, the term "module" refers to an application specific integrated circuit (ASIC), an electronic circuit, a processor (shared, dedicated, or group) and memory that execute one or more software or firmware programs, a combinational logic circuit, and/or other suitable components that provide the described functionality.

Referring now to FIG. 1, a vehicle 126 is shown and includes an engine 128 and a controller 130. The controller 130 is preferably the engine control module; however, the controller 130 can be a stand-alone controller or combined with other onboard controllers. The controller 130 includes a processor, memory such as random access memory (RAM), read-only memory (ROM), and/or other suitable electronic storage.

The engine 128 includes a cylinder 132 having a fuel injector 134 and a spark plug 136. Although a single cylinder 132 is shown, it will be appreciated that the engine 128 typically includes multiple cylinders 132 with associated fuel injectors 134 and spark plugs 136. For example, the engine 128 may include 4, 5, 6, 8, 10, or 12 cylinders 132.

Air is drawn into an intake manifold 138 of the engine 128 through an inlet 140. A throttle 142 regulates the airflow through the inlet 140. Fuel and air are combined in the cylinder 132 and are ignited by the spark plug 136. The throttle 142 is actuated to control air flowing into the intake manifold 138. The controller 130 adjusts the flow of fuel through the fuel injector 134 based on the air flowing into the cylinder 132 to control the air-to-fuel (A/F) ratio within the cylinder 132.

The controller 130 communicates with an engine speed sensor 144, which generates an engine speed signal. The controller 130 also communicates with mass air flow (MAF) and manifold absolute pressure (MAP) sensors 146 and 148, which generate MAF and MAP signals, respectively. The controller 130 communicates with a throttle position sensor (TPS) 150, which generates a TPS signal.

Figure 2:
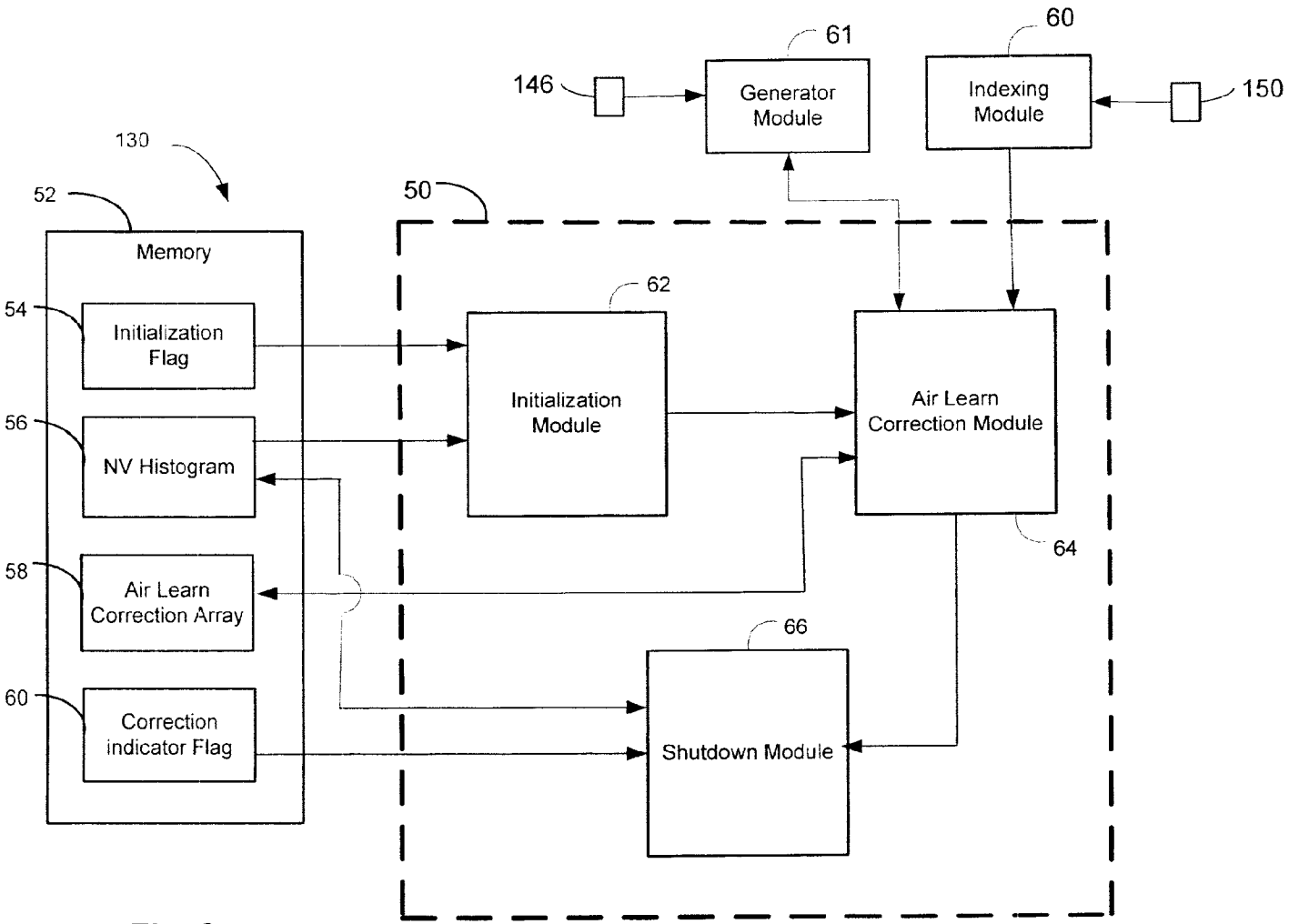
FIG. 2 is a block diagram depicting an electronic throttle control correction system in accordance with the present invention.

Referring now to FIG. 2, the controller 130 includes a memory 52 that stores information such as whether an initialization flag 54 is set, a non-volatile (NV) histogram 56 that is updated, and a correction array 58 that is updated. The initialization flag 54 is set true on initialization events. Initialization events include, but are not limited to, power-ups, running resets and/or all other resets.

An electronic throttle control correction system 50 includes an initialization module 62 that monitors the initialization flag 54. If the initialization flag 54 is set true, the initialization module 62 determines an air-learn threshold by examining a NV histogram 56. The air-learn threshold is based the lowest cell index of a correction array 58 where a learned-correction value was calculated or "learned" during a previous key cycle. Learned-correction values are used to correct for airflow variation by repositioning a throttle blade. The NV histogram 56 stores the number of times a given learned airflow correction cell was updated during a previous key cycle.

The initialization module 62 initializes the values of an old air-learn index and an air-learn value to zero and clears the cells of a volatile (V) histogram. The air-learn index is a pointer to the correction array 58. The air-learn value stores the number of continuous writes that occur at a given air-learn index during a single key cycle. The second air-learn index represents a one-loop old value of the air-learn index while executing the air-learn correction routine 200 depicted in FIG. 4. The V histogram stores the number of times during a single key cycle a given cell of the correction array 58 was updated.

A correction module 64 writes a learned-correction value to the correction array 58 at a first air-learn index. The generator module 61 generates the learned-correction value that corresponds to the first air-learn index that is determined by the indexing module 60. An indexing module 60 determines the first air-learn index as a function of a desired throttle level and passes the air-learn index to the correction module 64. The indexing module 60 communicates with the TPS 150 to determine the current desired throttle level.

The correction module 64 then checks whether the first air-learn index meets three conditions: (1) whether the air-learn threshold exceeds or is equal to the first air-learn index; (2) whether the first air-learn index is equal to the second air-learn index; and (3) whether the first air-learn index is greater than zero. If all three conditions are met, the correction module 64 increments the air-learn value and the correction module 64 determines whether the air-learn value exceeds or is equal to a stability threshold. In an exemplary embodiment, the stability threshold can be calibrated. If the value exceeds or is equal to the stability threshold, the air-learn threshold is updated to the cell referenced by the first air-learn index, and the correction module 64 writes the learned-correction value to additional cells of the correction array 58. In an exemplary embodiment, the correction module 64 can write the learned-correction value from a first cell of the correction array 58, $cell_0$, to the cell of the correction array 58 adjacent to the first air learn index that has not been written to during the current key cycle, $cell_{first\ air-learn\ index-1}$.

In an alternate embodiment, the correction module 64 can write a calibrated percentage of the learned-correction value determined for the first air-learn index to a calibrated number of cells adjacent to the cell of the correction array 58 referenced by the first air learn index.

If any of the three conditions are not met, the correction module 64 sets the air-learn value equal to zero and sets the second air-learn index equal to the first air-learn index.

Whether or not the three conditions are satisfied, the correction module 64 increments the V histogram upon the initial write of the learned-correction value to the correction array 58.

The shutdown module 66 determines whether a cell of the V histogram contains a value equal to zero for each cell of the V histogram. In an exemplary embodiment, the shutdown module 66 begins by determining whether all cells of the V histogram equal zero. If all cells of the V histogram do not equal zero, then the shutdown controller 66 begins reading the V histogram at a first cell, $cell_0$. If the value of the first cell of the V histogram does not equal to zero, the shutdown module 66 determines whether the sum of the values of the first cell of the V histogram and the corresponding cell of the NV histogram 56 exceeds a NV histogram threshold.

If the NV histogram threshold exceeds the sum, then the shutdown module 66 increments the NV histogram 56 cell value by the corresponding V histogram cell value. If the sum exceeds the NV histogram threshold, then the shutdown module 66 sets the current cell value of the NV histogram 56 equal to the NV threshold. The shutdown module 66 proceeds to increment a loop pointer to move to the next cell of the NV histogram 56.

If the current cell value of the V histogram does equal zero, the shutdown module 66 decrements the current cell of the NV histogram 56 by a calibrated value. The shutdown module 66 proceeds to increment a loop pointer to move to the next cell of the NV histogram 56.

The shutdown module 66 determines whether the loop pointer of the NV histogram is greater than or equal to zero and less than or equal to a predetermined value, n. In an exemplary embodiment, n can equal 16. If the loop pointer is equal to or exceeds zero and less than or equal to n, the shutdown module 66 determines whether the next cell value of the V histogram is equal to zero and the above procedure is repeated for all cells up to value n.

In an alternate embodiment, the controller 130 updates the correction array 58 based on residual values. The controller 130 examines a stored residual value that equals the difference between the actual airflow measured by the MAF 146 and an estimated air flow calculated from a predetermined compressible flow equation (not shown). The stored residual values are maintained in a residual array (not shown) for each corresponding cell of the correction array 58 in which a learned-correction value has been stored. The controller 130 compares the value of each cell of the residual array stored below the first air-learn index of the correction array 58 to a predetermined residual threshold. The controller 130 writes the learned-correction value of the first air-learn index to each lower cell of the correction array 58 in which the corresponding residual value of that cell exceeds the predetermined residual threshold. After each write of the leamedcorrection value performed by the controller 130 to the lower cells of the correction array 58, the controller 130 clears the residual array in preparation for the next learn event.

Figure 3:
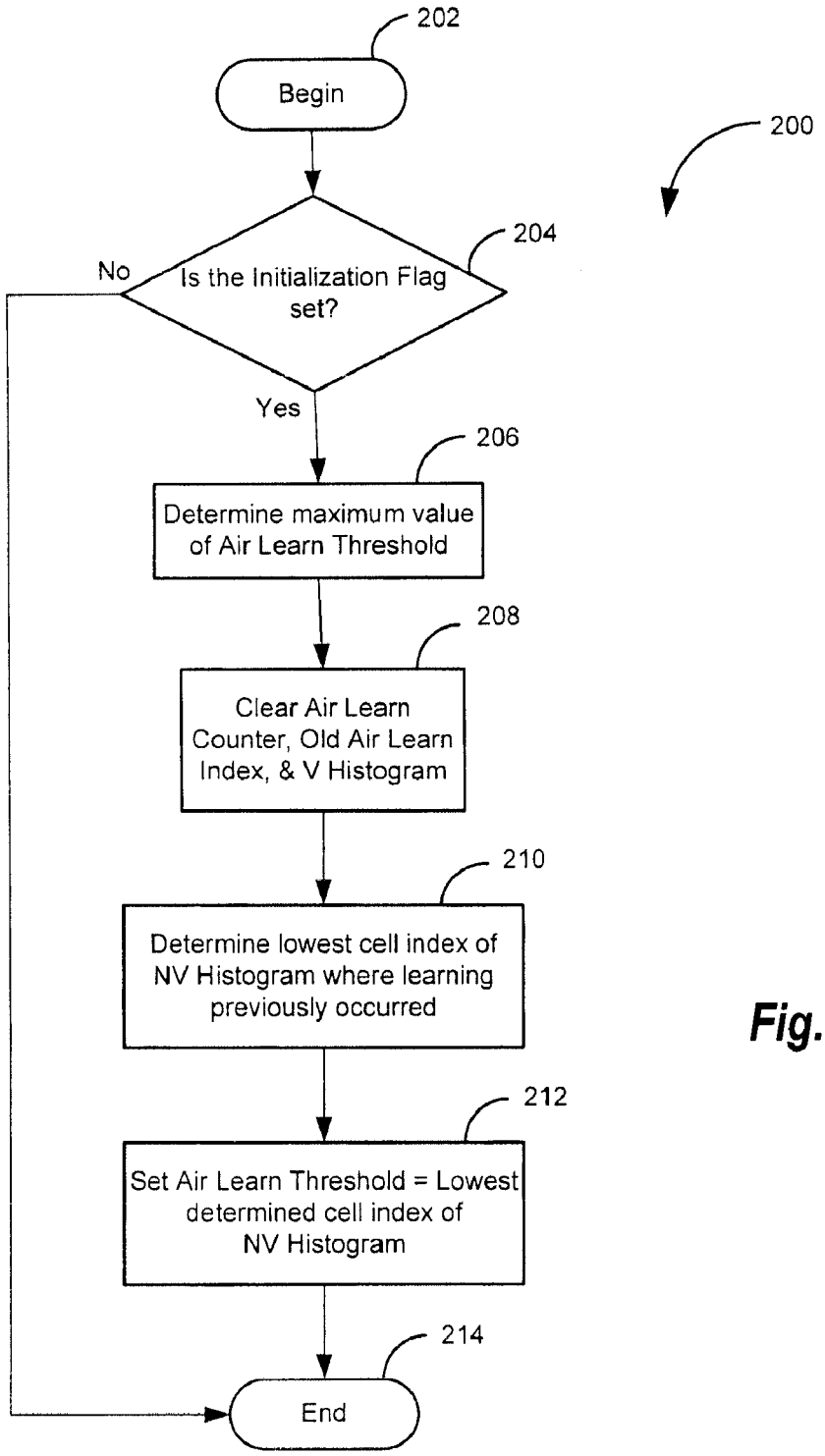
FIG. 3 is a flow chart illustrating an exemplary method for an initialization routine according to the present invention.

Referring now to FIG. 3, a method 200 for an initialization routine is shown. An initialization module 62 begins the method 200 at step 202. In step 204, the initialization module 62 determines whether the initialization flag 54 is set true. If an initialization event has occurred and the initialization flag 54 is set true, the initialization module 62 proceeds to step 206. If the initialization flag 54 is not set true, the method 200 ends.

In step 206, the initialization module 62 determines the maximum value for an air-learn threshold. In step 208, the initialization module 62 clears the values of an air-learn value, a second air-learn index, and the values contained in a V histogram.

In step 210, the initialization module 62 determines the lowest cell index of a correction array 58 where a learned-correction value was stored during a previous key cycle. In step 212, the initialization module 62 sets the air-learn threshold equal to the lowest cell index where learning previously occurred in step 210. The method 200 ends in step 214.

Figure 4:
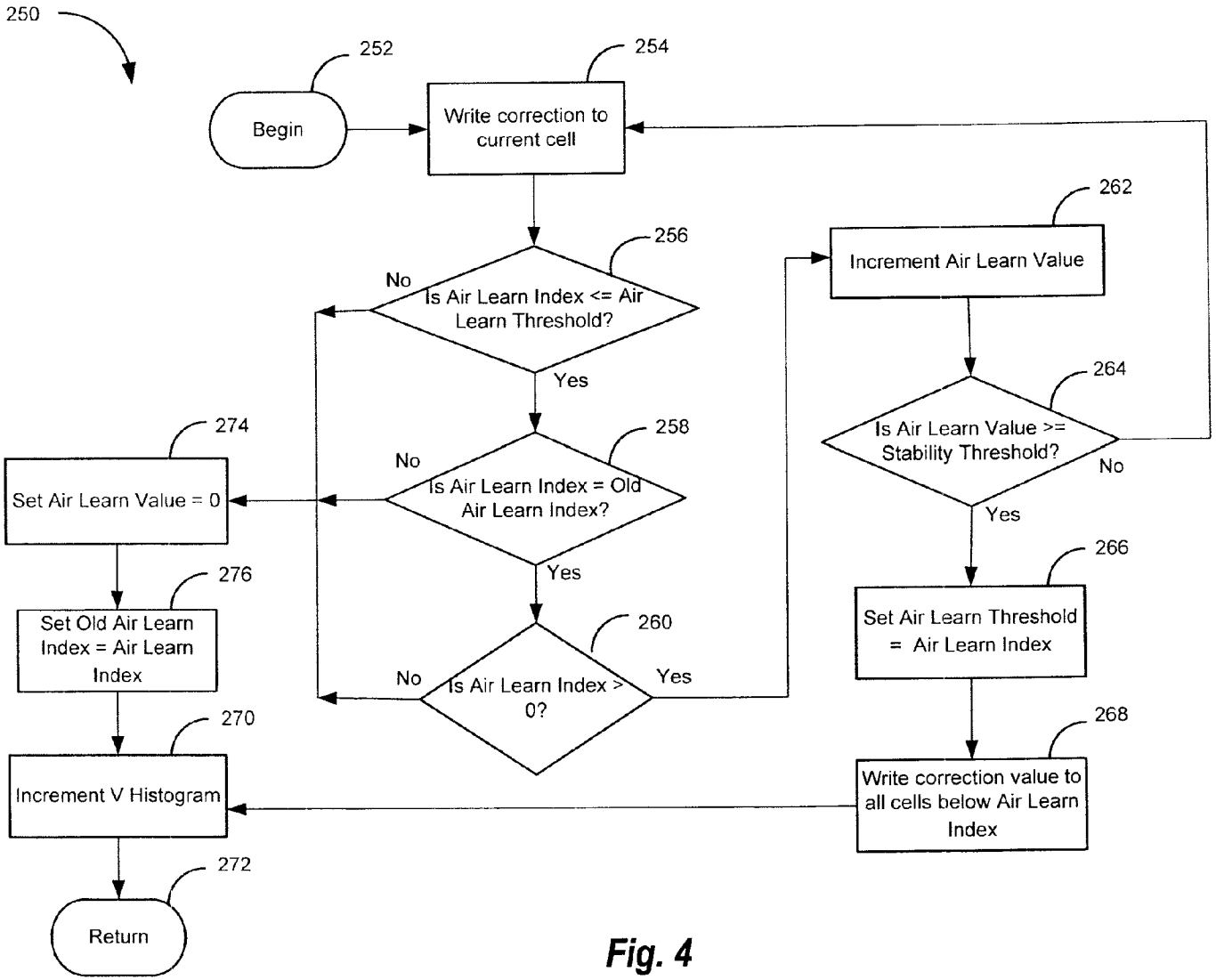
FIG. 4 is a flow chart illustrating an exemplary method for an air-learn correction routine according to the present invention.

Referring now to FIG. 4, a method 250 for an air-learn correction routine is shown. An air-learn correction module 64 begins the method 250 at step 252. In step 254, the air learn correction module 64 writes the learned-correction value to the first air-learn index of the correction array 58. The correction array 58 is indexed by the air-learn index. The correction module 64 then checks if three conditions are met: (1) in step 256, whether an air-learn threshold is equal to or exceeds or is the first air-learn index; (2) in step 258, whether the first air-learn index is equal to the second air-learn index; and (3) in step 260, whether the first air-learn index is greater than zero.

If all three conditions are satisfied, then in step 262, the air-learn value is incremented. In step 264, the correction module 64 determines whether the value of the air-learn value is equal to or has exceeded a stability threshold. If the value of the air-learn value is not equal to or greater than the stability threshold, then the correction module 64 returns to step 254. If in step 264, the air-learn value is equal to or has exceeded the stability threshold, then in step 266, the correction module 64 sets the air-learn threshold equal to first air-learn index.

In step 268, the correction module 64 writes the learned-correction value from step 254 to other cells of the correction array 58. In an exemplary embodiment, the correction module 64 can write the learned-correction value from $cell_0$ to $cell_{first\ air-learn\ index-1}$. In step 270, the correction module 64 increments the V histogram, and the method 250 ends in step 272.

If any of the three conditions in steps 256, 258, 260 are not met, then in step 274, the correction module 64 sets the air-learn value equal to zero. In step 278, the correction module 64 sets the second air-learn index equal to the first air-learn index. In step 270, the correction module 64 increments the V histogram, and the method 250 ends in step 272. In an exemplary embodiment, the method 250 may be periodically repeated during a single key cycle.

Figure 5:
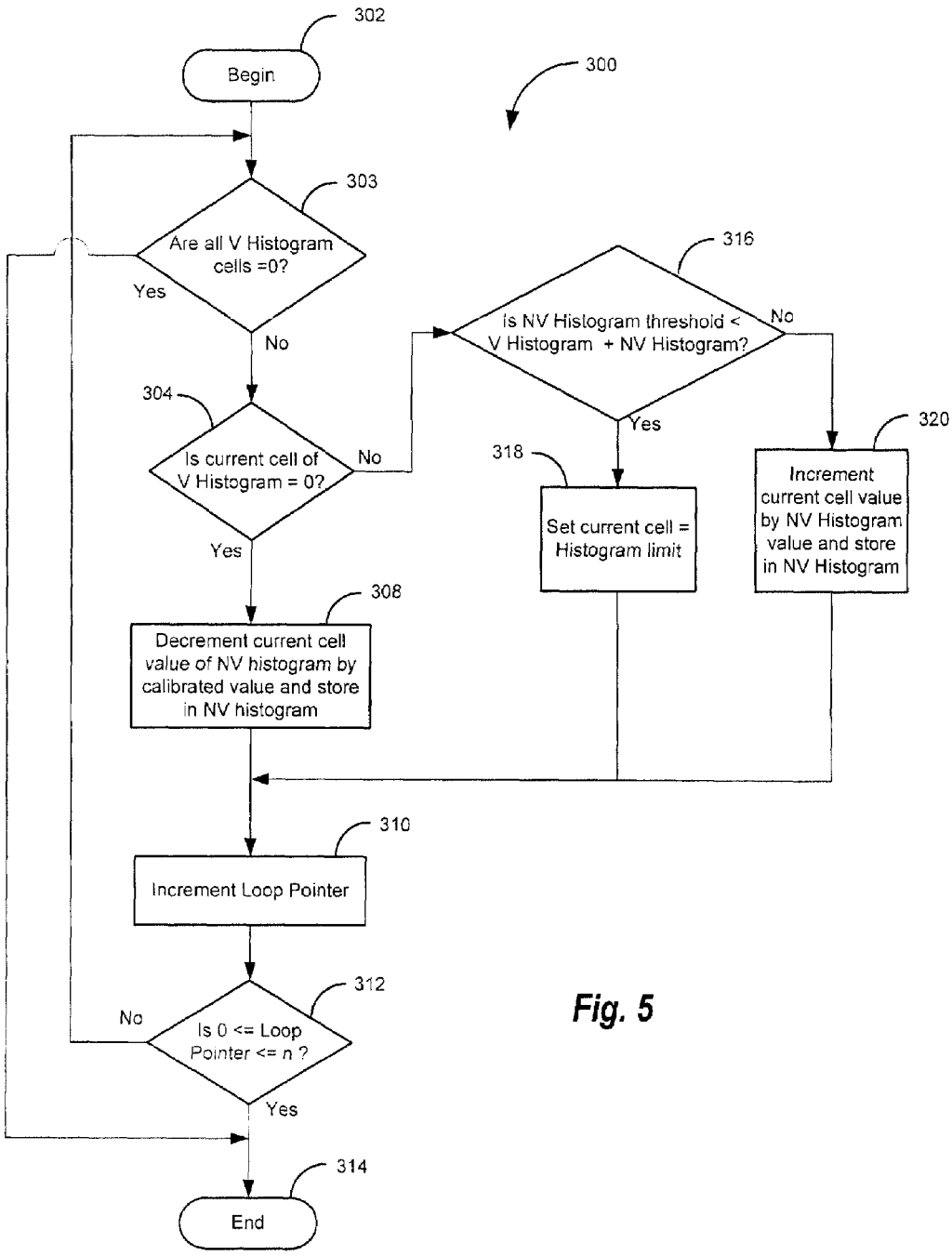
FIG. 5 is a flow chart illustrating an exemplary method for an shutdown routine according to the present invention.

Referring now to FIG. 5, a method 300 for a shutdown routine is shown. A shutdown module 66 begins the method 300 at step 302. In step 303, the shutdown module 66 determines if all the V histogram cells are equal to zero. If all the V histogram cells are not equal to zero, the shutdown module proceeds to step 304. If, however, all the V histogram cells are equal to zero, the shutdown module 66 ends in step 314. In step 304, the shutdown module 66 determines if a current cell value of the V histogram is equal to zero. In an exemplary embodiment, the shutdown module 66 can begin its determination with the $cell_0$ of the V histogram. If the value is not equal to zero, the shutdown module 66 proceeds to step 316.

In step 316, the shutdown module 66 determines whether the sum of the values of the current cell of the NV histogram 56 and the corresponding cell of the V histogram exceed a NV histogram threshold. If the NV histogram threshold exceeds the sum, then the shutdown module 66 increments the NV histogram cell value by the V histogram value in step 320. If the sum exceeds the NV histogram threshold, then the shutdown module 66 sets the current cell value of the NV histogram 56 equal to the NV histogram threshold in step 318. The shutdown module 66 then proceeds to step 310.

However, in step 304, if the current cell is equal to zero, the shutdown module 66 decrements the current cell of the NV histogram 56 by a calibrated value in step 308. In step 310, the shutdown module 66 increments a loop pointer to move to the next cell of the NV histogram 56. In step 312, the shutdown module 66 determines whether the loop pointer exceeds or is equal to zero and below or equal to a predetermined value, n. In an exemplary embodiment, the value of n can equal but is not limited to 16. If the loop counter is greater than or equal to zero and less than or equal to n, the shutdown module 66 returns to step 304. If the loop counter is not greater than or equal to zero and less than or equal to n, the shutdown ends in step 314.

Those skilled in the art can now appreciate from the foregoing description that the broad teachings of the present invention can be implemented in a variety of forms. Therefore, while this invention has been described in connection with particular examples thereof, the true scope of the invention should not be so limited since other modifications will become apparent to the skilled practitioner upon a study of the drawings, the specification and the following claims.

What is claimed is:

1. A correction system for electronic throttle control, comprising:

a generator module that generates a learned-correction value corresponding to a first air-learn index, wherein said learned-correction value is used to compensate a throttle position; and a correction module that writes to a throttle position correction array with said learned-correction value when an air-learn value equals a predetermined stability threshold.

2. The correction system of claim 1 further comprising:

a throttle position sensor that senses throttle position and an indexing module that generates said first air-learn index based on said throttle position.

3. The correction system of claim 1 wherein said air-learn value is set equal to zero and a second air-learn index is set equal to said first air-learn index when stability conditions are not satisfied.

4. The correction system of claim 1 wherein said correction module increments a volatile histogram at said first air-learn index when said learned-correction value is stored at said first air-learn index of said throttle position correction array.

5. The correction system of claim 1 wherein said correction module increments said air-learn value when stability conditions are satisfied and updates an air-learn threshold to equal said first air-learn index when said air-learn value equals said predetermined stability threshold.

6. The correction system of claim 5 wherein said stability conditions include at least one of: said air-learn index does not exceed said air-learn threshold, said first air-learn index is equal to a second air-learn index, and said air-learn index is greater than zero.

7. The correction system of claim 4 further comprising:

a shutdown module that updates a non-volatile histogram indexed by air lean indexes based on said volatile histogram.

8. The correction system of claim 7 wherein said shutdown module updates said non-volatile histogram when at least one cell in said volatile histogram exceeds zero.

9. The correction system of claim 8 further comprising:

an initialization module that clears said air-learn value, that sets a second air-learn index equal to zero, and that determines said air-learn threshold when at least one of: power-up, running reset, and other reset has occurred.

10. The correction system of claim 9 wherein said initialization module sets said air-learn threshold equal to a cell of said non-volatile histogram, wherein said cell contains a value that is greater than zero.

11. A method for controlling an electronic throttle system comprising:

generating a learned-correction value corresponding to a first air-learn index, wherein said learned-correction value is used to compensate a throttle position; and updating said throttle position correction array with said learned-correction value when said air-learn value equals a predetermined stability threshold.

12. The method of claim 11 further comprising sensing throttle position and generating said first air-learn index based on said throttle position.

13. The method of claim 11 wherein said air-learn value is set equal to zero and a second air-learn index is set equal to said first air-learn index when said stability conditions are not satisfied.

14. The method of claim 11 further comprising:

incrementing a volatile histogram at said first air-learn index when said learned-correction value is stored at said first air-learn index of said throttle position correction array.

15. The method of claim 11 wherein said correction module increments an air-learn value when said stability conditions are satisfied and updates an air-learn threshold to equal said first air-lean index when said air-learn value equals said predetermined stability threshold.

16. The method of claim 15 wherein said stability conditions include at least one of: said air-learn index does not exceed said air-learn threshold, said first air-learn index is equal to a second air-learn index, and said air-learn index is greater than zero.

17. The method of claim 14 further comprising:

updating a non-volatile histogram indexed by air lean indexes based on said volatile histogram.

18. The method of claim 17 wherein said non-volatile histogram is updated when at least one cell in said volatile histogram exceeds zero.

19. The method of claim 17 wherein said air-learn value is cleared, a second air-learn index is set equal to zero, and said air-learn threshold is determined when at least one of: power-ups, running resets, and other resets has occurred.

20. The method of claim 19, wherein said air-learn threshold is set equal to a cell of said non-volatile histogram, wherein said cell contains a value that is greater than zero.

* * * * *